US010421642B2

(12) United States Patent
Roberts et al.

(10) Patent No.: US 10,421,642 B2
(45) Date of Patent: Sep. 24, 2019

(54) ELEVATOR COMPONENT SEPARATION ASSURANCE SYSTEM AND METHOD OF OPERATION

(71) Applicant: Otis Elevator Company, Farmington, CT (US)

(72) Inventors: Randall Roberts, Hebron, CT (US); Richard N. Fargo, Plainville, CT (US); David Ginsberg, Granby, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 16/023,684

(22) Filed: Jun. 29, 2018

(65) Prior Publication Data

US 2018/0305183 A1 Oct. 25, 2018

Related U.S. Application Data

(62) Division of application No. 15/274,483, filed on Sep. 23, 2016, now Pat. No. 10,035,684.

(Continued)

(51) Int. Cl.
*B66B 11/04* (2006.01)
*B66B 1/32* (2006.01)

(Continued)

(52) U.S. Cl.
CPC ..... *B66B 11/0407* (2013.01); *B66B 1/2491* (2013.01); *B66B 1/32* (2013.01); *B66B 9/003* (2013.01)

(58) Field of Classification Search
CPC ..... B66B 11/0407; B66B 1/2491; B66B 1/32; B66B 9/003

(Continued)

(56) References Cited

U.S. PATENT DOCUMENTS 4,989,695 A * 2/1991 Kubo ..... B66B 1/18 187/247
5,419,414 A * 5/1995 Sakita ..... B66B 1/2433 187/247

(Continued)

FOREIGN PATENT DOCUMENTS

WO 2007145613 A2 12/2007
WO 2016126939 A1 8/2016

OTHER PUBLICATIONS

Extended European Search Report for application No. 16275141.6-1731 dated Mar. 14, 2017 (11 pages).

*Primary Examiner* — David S Warren
(74) *Attorney, Agent, or Firm* — Cantor Colburn LLP

(57) ABSTRACT

An elevator component separation assurance system includes a controller, and a brake controller. The controller includes an electronic processor, a computer readable storage medium, a safety motion state estimator, and a safety assurance module. The safety motion state estimator is configured to identify velocity and position of each one of a plurality of elevator components. The safety assurance module is configured to select a separation map from a plurality of pre-pre-programmed separation maps for each one of an adjacent component pair of the plurality of elevator components for initiating a Ustop that maintains elevator component separation. The brake controller is carried by each one of the plurality of elevator components, and is configured to actuate a secondary brake upon detection of a loss of communication with at least a portion of the controller.

12 Claims, 17 Drawing Sheets

Related U.S. Application Data

(60) Provisional application No. 62/232,763, filed on Sep. 25, 2015.

(51) Int. Cl.
*B66B 9/00* (2006.01)
*B66B 1/24* (2006.01)

(58) Field of Classification Search
USPC ..... 187/247
See application file for complete search history.

(56) References Cited

U.S. PATENT DOCUMENTS 5,482,143 A * 1/1996 Saito ..... B66B 1/2433 187/292
5,663,538 A * 9/1997 Sakita ..... B66B 1/2466 187/249
5,861,586 A 1/1999 McCarthy et al.
5,865,274 A 2/1999 Kiji et al.
5,877,462 A 3/1999 Chenais
5,924,524 A 7/1999 Barker et al.
6,273,217 B1 * 8/2001 Hikita ..... B66B 1/18 187/382
6,364,065 B1 * 4/2002 Hikita ..... B66B 1/2466 187/382
6,955,245 B2 10/2005 Dunser et al.
7,213,685 B2 * 5/2007 Hikita ..... B66B 1/20 187/249
7,353,912 B2 4/2008 Reuter et al.
7,357,226 B2 * 4/2008 Sakita ..... B66B 11/0095 187/249
7,389,857 B2 * 6/2008 Hikita ..... B66B 1/2466 187/249
7,487,860 B2 * 2/2009 Hikita ..... B66B 1/2433 187/249
7,537,089 B2 * 5/2009 Duenser ..... B66B 1/2466 187/247
7,621,376 B2 * 11/2009 Duenser ..... B66B 9/00 187/247
7,650,966 B2 * 1/2010 Sansevero ..... B66B 1/2466 187/249
7,753,175 B2 * 7/2010 Fanion ..... B66B 11/0206 187/250
7,779,967 B2 * 8/2010 Kocher ..... B66B 5/0031 187/249
7,784,588 B2 * 8/2010 SikShin ..... B66B 1/2433 187/249
7,819,228 B2 * 10/2010 Terry ..... B66B 5/286 187/249
7,841,450 B2 11/2010 Smith et al.
7,857,104 B2 * 12/2010 Kocher ..... B66B 9/00 187/249
7,980,362 B2 * 7/2011 Kostka ..... B66B 5/0031 187/249
8,020,668 B2 * 9/2011 Hsu ..... B66B 5/0031 187/249
8,087,497 B2 * 1/2012 Fargo ..... B66B 7/068 187/249
8,100,230 B2 * 1/2012 Smith ..... B66B 1/18 187/249
8,132,652 B2 * 3/2012 Hakala ..... B66B 1/2458 187/249
8,230,977 B2 * 7/2012 Thumm ..... B66B 1/34 187/247
8,292,038 B2 * 10/2012 McCarthy ..... B66B 13/22 187/249
8,297,409 B2 * 10/2012 Hsu ..... B66B 1/2433 187/247
8,307,952 B2 * 11/2012 Fargo ..... B66B 9/00 187/251
8,356,697 B2 * 1/2013 Kriss ..... B66B 5/02 187/249
8,371,420 B2 * 2/2013 Kondo ..... B66B 1/32 187/288
8,424,599 B2 4/2013 Atencio
8,424,650 B2 4/2013 Brand
8,424,651 B2 * 4/2013 Brand ..... B66B 5/0031 187/249
8,434,599 B2 * 5/2013 Wang ..... B66B 5/0031 187/249
8,602,168 B2 * 12/2013 Tschuppert ..... B66B 9/00 187/249
8,739,936 B2 * 6/2014 Kostka ..... B66B 1/2433 187/249
8,813,919 B2 * 8/2014 Silberhorn ..... B66B 5/0031 187/249
9,010,499 B2 4/2015 McCarthy et al.
9,096,410 B2 * 8/2015 Iwata ..... B66B 5/024
9,296,590 B2 * 3/2016 Kocher ..... B66B 1/30
9,394,139 B2 * 7/2016 Kugiya ..... B66B 1/32
9,650,226 B2 * 5/2017 Jacobs ..... B66B 1/24
9,708,158 B2 * 7/2017 Kakio ..... B66B 5/0031
9,738,492 B2 * 8/2017 King ..... B66B 9/00
9,758,347 B2 * 9/2017 Dudde ..... B66B 9/00
2010/0065378 A1 * 3/2010 Christy ..... B66B 5/0031 187/247
2011/0240412 A1 10/2011 Schienda et al.
2013/0299282 A1 11/2013 Kugiya et al.
2017/0073183 A1 * 3/2017 Ginsberg ..... B66B 5/06
2017/0088395 A1 * 3/2017 Roberts ..... B66B 1/2491
2019/0084797 A1 * 3/2019 Fonteneau ..... B66B 5/0031

* cited by examiner

ELEVATOR COMPONENT SEPARATION ASSURANCE SYSTEM AND METHOD OF OPERATION

CROSS REFERENCE TO RELATED APPLICATION

This application is a divisional application of U.S. patent application Ser. No. 15/274,483, filed Sep. 23, 2016, which claims priority to U.S. Provisional Application No. 62/232,763 filed Sep. 25, 2015, the entire contents of which are incorporated herein by reference.

BACKGROUND

The present disclosure relates to elevator systems, and more particularly to an elevator braking control system for assuring moving components of the elevator system are separated.

Self-propelled elevator systems, also referred to as ropeless elevator systems, are useful in certain applications (e.g., high rise buildings) where the mass of the ropes for a roped system is prohibitive and/or there is a need for multiple elevator cars in a single hoistway. For ropeless elevator systems, it may be advantageous to actuate mechanical braking of the elevator car from the car itself. Similarly, it may be advantageous to actuate or control the propulsion of the elevator car generally from the hoistway side for power distribution and other reasons. To realize both of these advantages, a communication link should exist between the car and the hoistway side to perform reliable braking operations. Moreover, with systems having multiple elevator cars, braking of one car may influence the separation between cars. Improvements in elevator car braking control and/or car separation assurance are desirable.

SUMMARY

A method of operating an elevator car separation assurance system according to one, non-limiting, embodiment of the present disclosure includes determining a position and velocity of each one of a plurality of cars by a safety motion state estimator; determining a separation map associated with a first car and an adjacent second car of the plurality of cars by a safety assurance module; initiating a first separation assurance-induced event associated with at least one of the first and the second cars and based on the separation map; detecting the first separation assurance-induced event by a recovery manager; and slowing at least a third car of the plurality of cars down based on the detection by the recovery manager.

Additionally to the foregoing embodiment, the first separation assurance-induced event is a Ustop.

In the alternative or additionally thereto, in the foregoing embodiment, the first separation assurance-induced event is actuation of a secondary brake.

In the alternative or additionally thereto, in the foregoing embodiment, the method includes initiating a second separation assurance-induced event based on a second separation map; and stopping at least one of the plurality of cars by the recovery manager based on initiation of the first and second separation assurance-induced events.

In the alternative or additionally thereto, in the foregoing embodiment, the first car is in a lane and the second car is in a transfer station.

In the alternative or additionally thereto, in the foregoing embodiment, the first and second cars are in a transfer station.

In the alternative or additionally thereto, in the foregoing embodiment, the first and second cars are in a lane.

In the alternative or additionally thereto, in the foregoing embodiment, a first car is in a transfer station and the second car is in a parking station.

An elevator component separation assurance system according to another, non-limiting, embodiment includes a controller including an electronic processor, a computer readable storage medium, a safety motion state estimator configured to identify velocity and position of each one of a plurality of elevator components, and a safety assurance module configured to select a pre-programmed separation map of a plurality of pre-programmed separation maps for each one of an adjacent component pair of the plurality of elevator components for initiating a Ustop that maintains elevator component separation; and a brake controller carried by each one of the plurality of elevator components and configured to actuate a secondary brake upon detection of a loss of communication with at least a portion of the controller.

Additionally to the foregoing embodiment, the safety motion state estimator and safety assurance module are software-based.

In the alternative or additionally thereto, in the foregoing embodiment, the elevator component separation assurance system includes a recovery manager configured to communicate with the safety assurance module and reduce the speed of at least one of the plurality of elevator components based on actuation of the Ustop.

In the alternative or additionally thereto, in the foregoing embodiment, the brake controller is configured to initiate a secondary brake upon a loss of communication with the safety assurance module.

In the alternative or additionally thereto, in the foregoing embodiment, the brake controller is configured to determine if a Ustop has occurred before initiating the secondary brake.

In the alternative or additionally thereto, in the foregoing embodiment, the safety assurance module is configured to actuate a secondary brake for maintaining elevator component separation, and the recovery manager is configured to reduce the speed of the plurality of elevator components based on actuation of the secondary brake.

In the alternative or additionally thereto, in the foregoing embodiment, the recovery manager is configured to stop at least one of the plurality of elevator components based on actuation of a plurality of Ustops by the safety assurance module.

In the alternative or additionally thereto, in the foregoing embodiment, the recovery manager is configured to stop at least one of the plurality of active elevator components based on at least one actuation of a Ustop by the safety assurance module and at least one actuation of a secondary brake by the safety assurance module.

In the alternative or additionally thereto, in the foregoing embodiment, the recovery manager is configured to confirm when it is safe to run following the actuation of the Ustop.

In the alternative or additionally thereto, in the foregoing embodiment, the adjacent component pair includes a first car disposed in a lane and a second car disposed in a transfer station.

In the alternative or additionally thereto, in the foregoing embodiment, the adjacent component pair includes a first car disposed in a transfer station and a second car disposed in a parking station.

In the alternative or additionally thereto, in the foregoing embodiment, the plurality of elevator components is a plurality of ropeless elevator cars.

The foregoing features and elements may be combined in various combinations without exclusivity, unless expressly indicated otherwise. These features and elements as well as the operation thereof will become more apparent in light of the following description and the accompanying drawings. However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
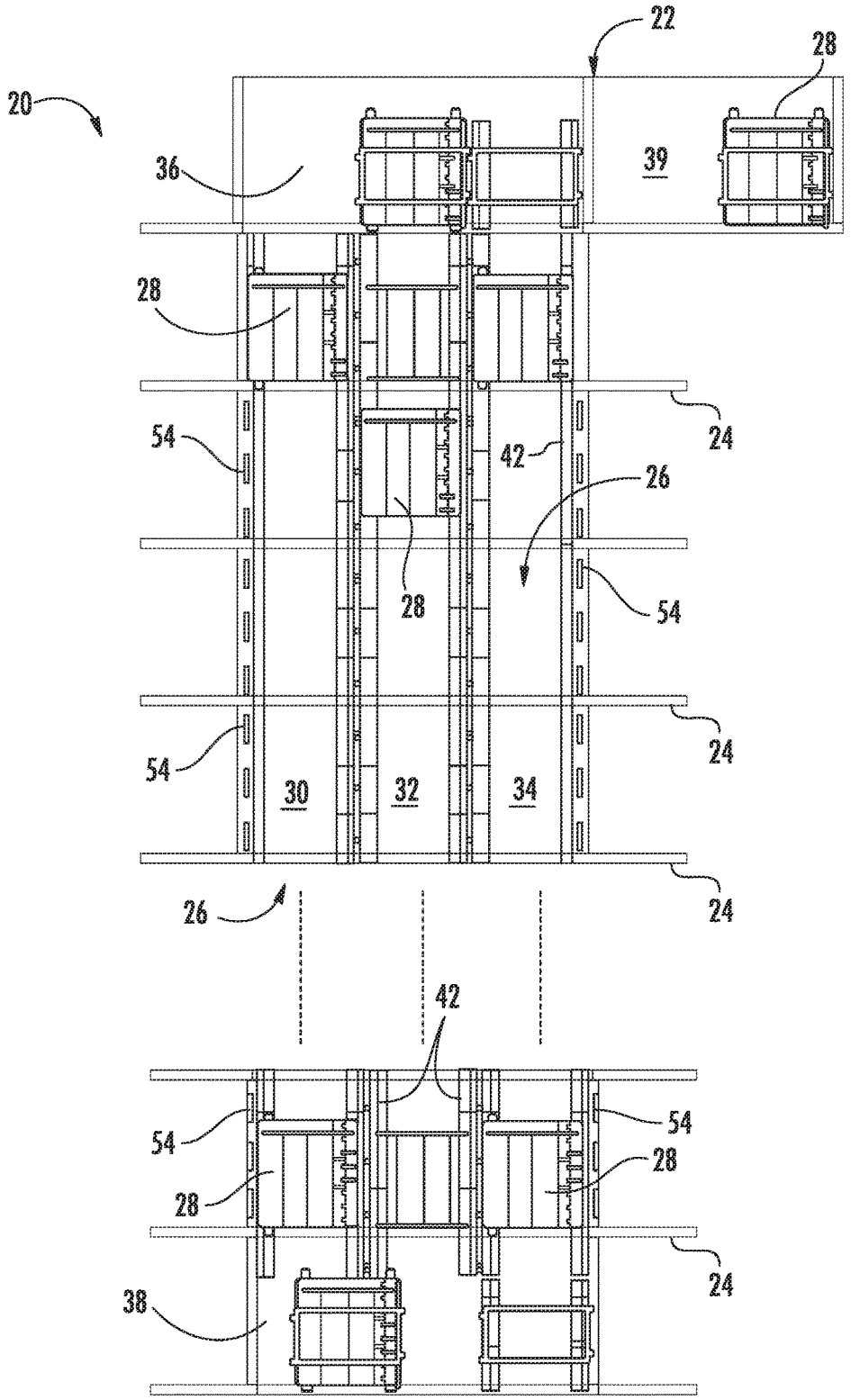
FIG. 1 depicts a multicar elevator system in an exemplary embodiment.

Ropeless Elevator System:

FIG. 1 depicts a self-propelled or ropeless elevator system 20 in an exemplary embodiment that may be used in a structure or building 22 having multiple levels or floors 24. Elevator system 20 includes a hoistway 26 defined by boundaries carried by the structure 22, and at least one car 28 adapted to travel in the hoistway 26. The hoistway 26 may include, for example, three lanes 30, 32, 34 with any number of cars 28 traveling in any one lane and in any number of travel directions (e.g., up and down). For example and as illustrated, the cars 28 in lanes 30, 34, may travel in an up direction and the cars 28 in lane 32 may travel in a down direction.

Above the top floor 24 may be an upper transfer station 36 that facilitates horizontal motion to elevator cars 28 for moving the cars between lanes 30, 32, 34. Below the first floor 24 may be a lower transfer station 38 that facilitates horizontal motion to elevator cars 28 for moving the cars between lanes 30, 32, 34. It is understood that the upper and lower transfer stations 36, 38 may be respectively located at the top and first floors 24 rather than above and below the top and first floors, or may be located at any intermediate floor. Each transfer station 36, 38 may further be associated and communicate with a parking station 39 for the storage and/or maintenance of the cars 28. Yet further, the elevator system 20 may include one or more intermediate transfer stations (not illustrated) located vertically between and similar to the upper and lower transfer stations 36, 38.

Figure 2:
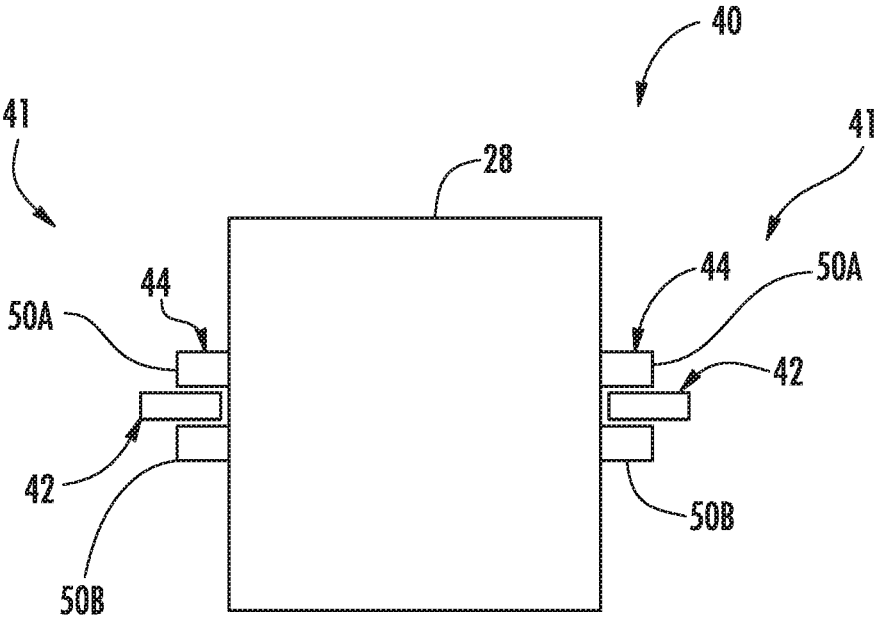
FIG. 2 is a top down view of a car and portions of a linear propulsion system in an exemplary embodiment.
Figure 3:
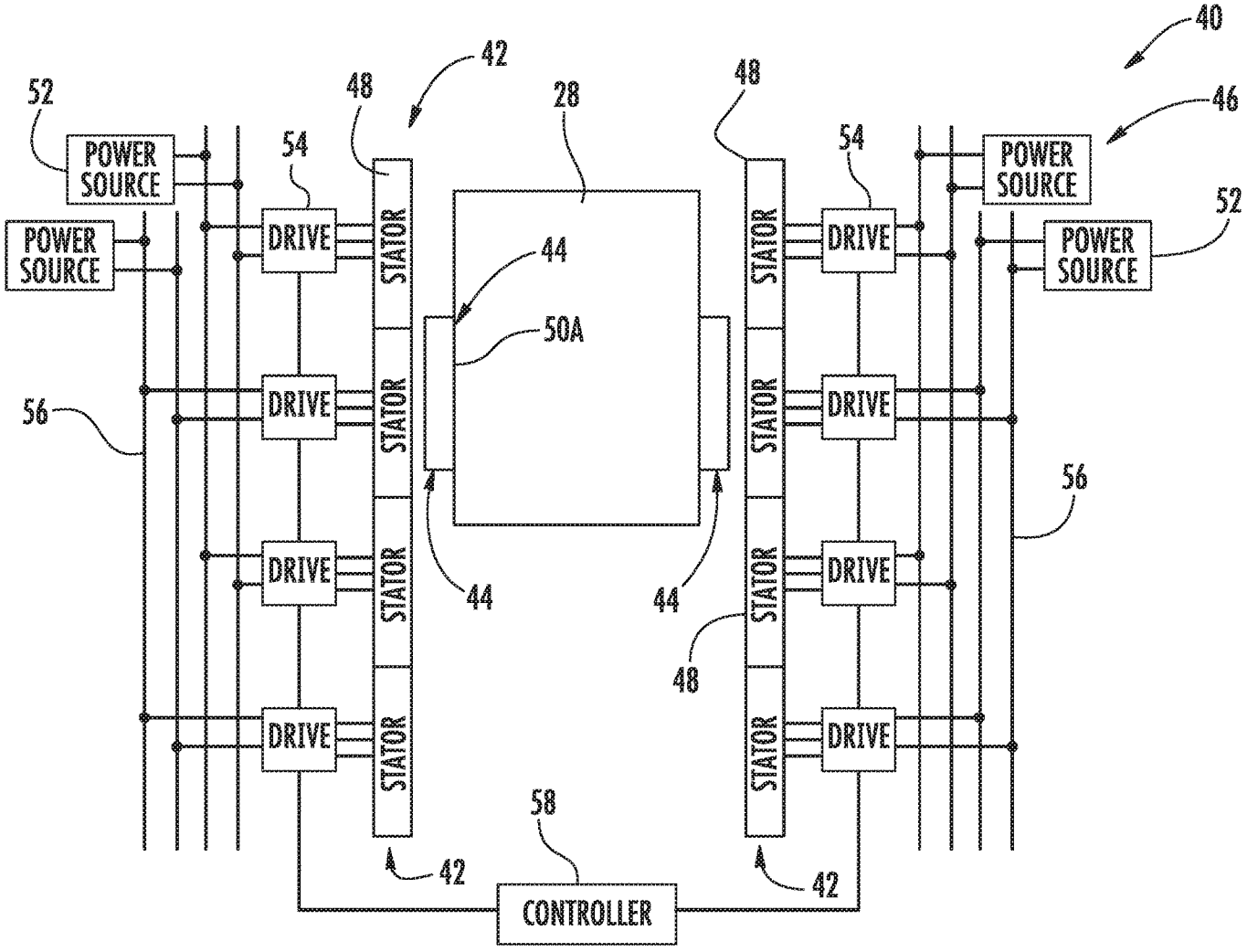
FIG. 3 is a schematic of the linear propulsion system.

Referring to FIGS. 1 through 3, the cars 28 are propelled using a linear propulsion system 40 that may have two linear propulsion motors 41 that may be generally positioned on opposite sides of the elevator cars 28, and a control system 46 (see FIG. 3). Each motor 41 may include a fixed primary portion 42 generally mounted to the building 22, and a moving secondary portion 44 mounted to the elevator car 28. The primary portion 42 includes a plurality of windings or coils 48 that generally form a row extending longitudinally along and projecting laterally into each of the lanes 30, 32, 34. Each secondary portion 44 may include two rows of opposing permanent magnets 50A, 50B mounted to each car 28. The plurality of coils 48 of the primary portion 42 are generally located between and spaced from the opposing rows of permanent magnets 50A, 50B. Primary portion 42 is supplied with drive signals from the control system 46 to generate a magnetic flux that imparts a force on the secondary portions 44 to control movement of the cars 28 in their respective lanes 30, 32, 34 (e.g., moving up, down, or holding still). It is contemplated and understood that any number of secondary portions 44 may be mounted to the car 28, and any number of primary portions 42 may be associated with the secondary portions 44 in any number of configurations. It is further understood that each lane may be associated with only one linear propulsion motor 41 or three or more motors 41. Yet further, the primary and secondary portions 42, 44 may be interchanged.

Referring to FIG. 3, the control system 46 may include power sources 52, drives 54 (i.e., inverters), buses 56 and a controller 58. The power sources 52 are electrically coupled to the drives 54 via the buses 56. In one non-limiting example, the power sources 52 may be direct current (DC) power sources. DC power sources 52 may be implemented using storage devices (e.g., batteries, capacitors), and may be active devices that condition power from another source (e.g., rectifiers). The drives 54 may receive DC power from the buses 56 and may provide drive signals to the primary portions 42 of the linear propulsion system 40. Each drive 54 may be an inverter that converts DC power from bus 56 to a multiphase (e.g., three phase) drive signal provided to a respective section of the primary portions 42. The primary portion 42 may be divided into a plurality of modules or sections, with each section associated with a respective drive 54.

The controller 58 may include an electronic processor and a computer readable storage medium for receiving and processing data signals and comparing such data to pre-programed profiles via, for example, pre-programmed algorithms. The profiles may be related to car velocity, acceleration, deceleration and/or position within a lane, transfer station and/or parking station 39. The controller 58 may provide thrust commands from a motion regulator (not shown) to control generation of the drive signals by the drives 54. The drive output may be a pulse width modulation (PWM). Controller 58 may be implemented using a processor-based device programmed to generate the control signals. The controller 58 may also be part of an elevator control system or elevator management system. Elements of the control system 46 may be implemented in a single, integrated module, and/or may be distributed along the hoistway 26.

Figure 4:
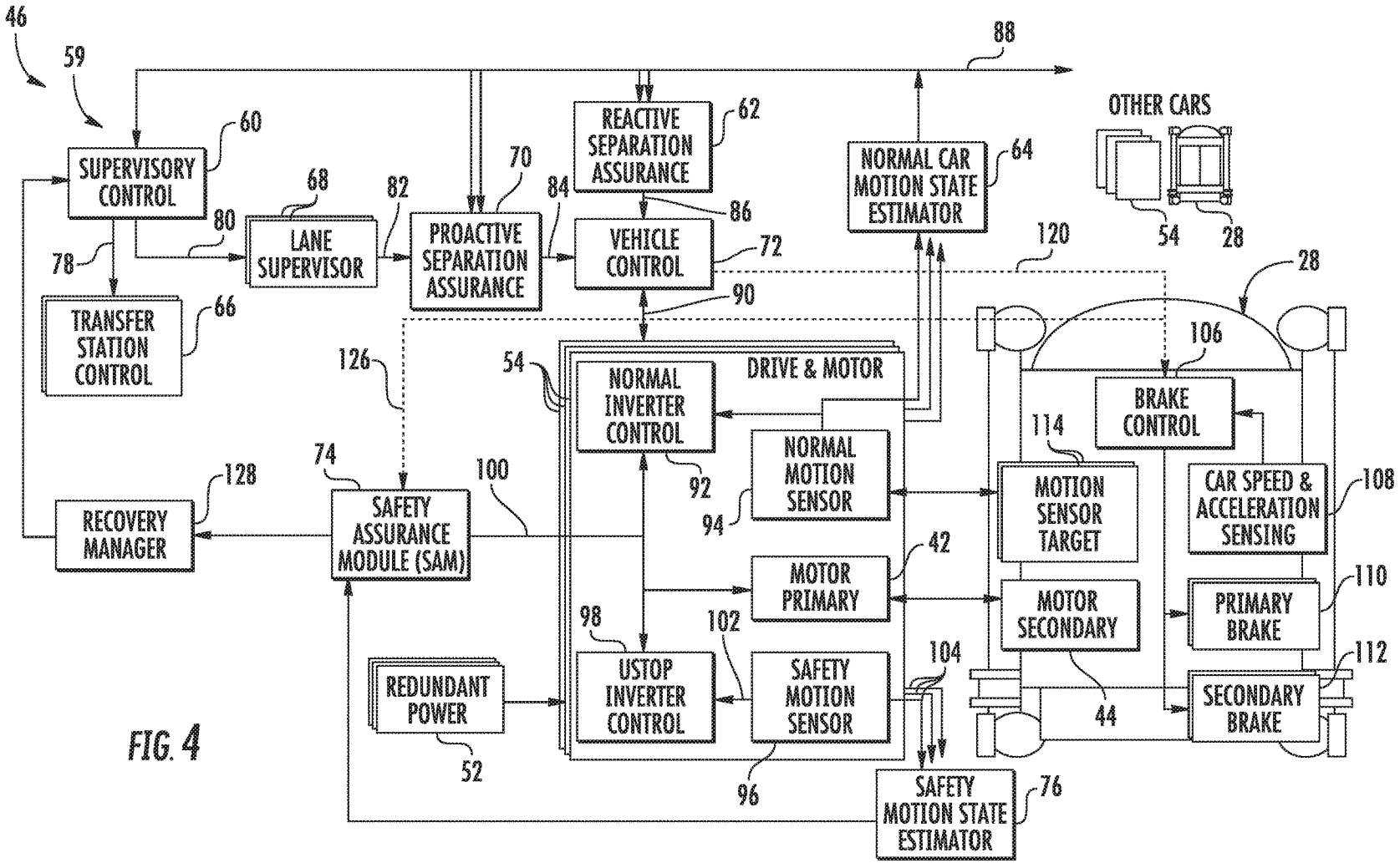
FIG. 4 is a block diagram of an elevator component separation assurance system of the elevator system.

Referring to FIG. 4, the control system 46 may generally include modules for assuring separation between multiple cars 28 in the lanes 30, 32, 34, transfer stations 36, 38 and parking stations 39. Any one or more modules may be software-based and part of the controller 58, and/or may include electronic and/or mechanical hardware including various detection devices. Modules of the controller 58 may include a supervisory control module 60, a reactive separation assurance module 62, a normal car motion state estimator 64, a transfer station control module 66, a lane supervisor module 68, a proactive separation assurance module 70, and a vehicle control module 72. The control system 46 may further include a safety assurance module 74 (SAM) and a safety motion state estimator 76, both being part of or separate from the controller 58.

An interface 78 provides communication between the supervisory control module 60 and the transfer station control module 66. An interface 80 provides communication between the supervisory control module 60 and the lane supervisor module 68. An interface 82 provides communication between the lane supervisor module 68 and the proactive separation assurance module 70. An interface 84 provides communication between the proactive separation assurance module 70 and the vehicle control module 72. An interface 86 provides communication between the reactive separation assurance module 62 and the vehicle control module 72. A communication bus 88 provides communication between a plurality of drives 54 associated with a first lane 30 and the cars 28 within the first lane, and a plurality of drives 54 associated with another lane 32 and the cars 28 within lane 32. For each lane 30, 32, 34, the communication bus 88 facilitates direct communication to the associated supervisory control module 60, the associated proactive separation assurance module 70, the associated reactive separation assurance module 62, and the associated normal car motion state estimator 64. The interfaces 80, 82, 84, 86 and the bus 88 may generally be hard wired for reliable communications. However, it is contemplated and understood that any number or portions of the interfaces may be wireless.

The vehicle control module 72 may be in two-way communication with each one of the drives 54 over an interface 90. Each drive 54 of the control system 46 may include a normal inverter control module 92, a normal motion sensor 94, a safety motion sensor 96 and a Ustop inverter control 98. The SAM 74 may be in direct communication with the normal inverter control module 92, the motor primary portion 42 and the Ustop inverter control module 98 of each one of the plurality of drives 54 over respective interfaces 100. The safety motion sensor 96 communicates with the Ustop inverter control module 98 via interface 102, and communicates with the safety motion state estimator 76 via interface 104. The interfaces 90, 100, 102, 104 may generally be hard wired for reliable communications. However, it is contemplated and understood that any number or portions of the interfaces may be wireless.

Each elevator car 28 may carry components and/or modules of the control system 46 that may include a brake control module 106, a car speed and acceleration sensing module 108, at least one primary brake 110, at least one secondary brake 112, and at least one motion sensor target 114. The motion sensor target 114 performs in conjunction with each one of the normal motion sensors 94 of each drive 54 to detect motion of the elevator car 28 with respect to each drive 54. The brake control module 106 communicates with the primary and secondary brakes 110, 112 via interface 116, and the car speed and acceleration sensing module 108 communicates with the brake control module via interface 118. The interfaces 116, 118 may generally be hard wired for reliable communications. However, it is contemplated and understood that any number or portions of the interfaces may be wireless.

Ustop Operation:

Stopping of the elevator car 28 may generally proceed in two phases. First, the elevator car 28 is decelerated by the drives 54 (i.e., inverters) and the propulsion motors 41. Second, the final stop of the car 28 is achieved by dropping the primary brake 110 (i.e., holding brake). During the slowing phase, each drive 54 which is in the vicinity of the car 28 may apply a current to the propulsion motor 41 in a way which results in deceleration of the car 28. This deceleration may continue until the speed of the car 28 becomes slow enough for the primary brake 110 to drop. The primary brake 110 is then dropped to achieve the final stop of the car 28. The on-car brake control module 106 may receive a command signal to either lift or drop the primary brake 110 at all times. If no command is received, the brake control module 106 may default to a drop primary brake decision.

The brake control module 106 may utilize the car speed and acceleration sensing module 108 (e.g., velocity sensor) to determine if the velocity is below the appropriate threshold before acting on a command to drop the primary brake 110. The SAM 74 may listen to the status from the brake control module 106 over the wireless interface 126 at all times, and if no status is received, the SAM 74, coupled with the Ustop inverter control module 98 may command the drives 54 and associated primary portions 42 to stop the car 28. The term 'Ustop' as used herein, may be understood to mean an urgent stop that may be initiated when the system determines that it may be undesirable for the elevator car to continue moving along a planned velocity profile. Ustops may be caused by undesirable conditions that may be unrelated to separation assurance.

Figure 5:
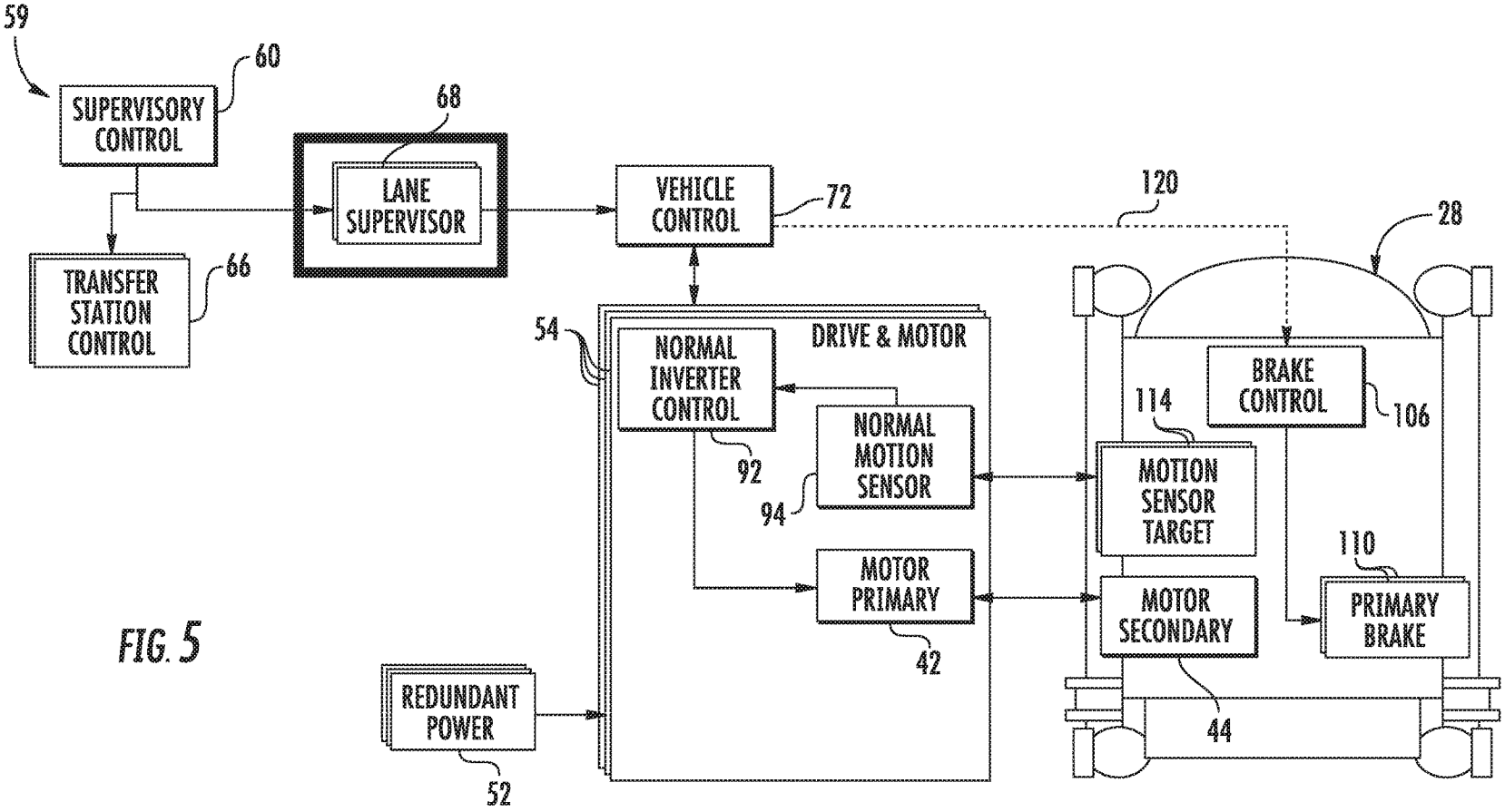
FIG. 5 is a block diagram of the elevator component separation assurance system illustrated in a first layer of operation.
Figure 6:
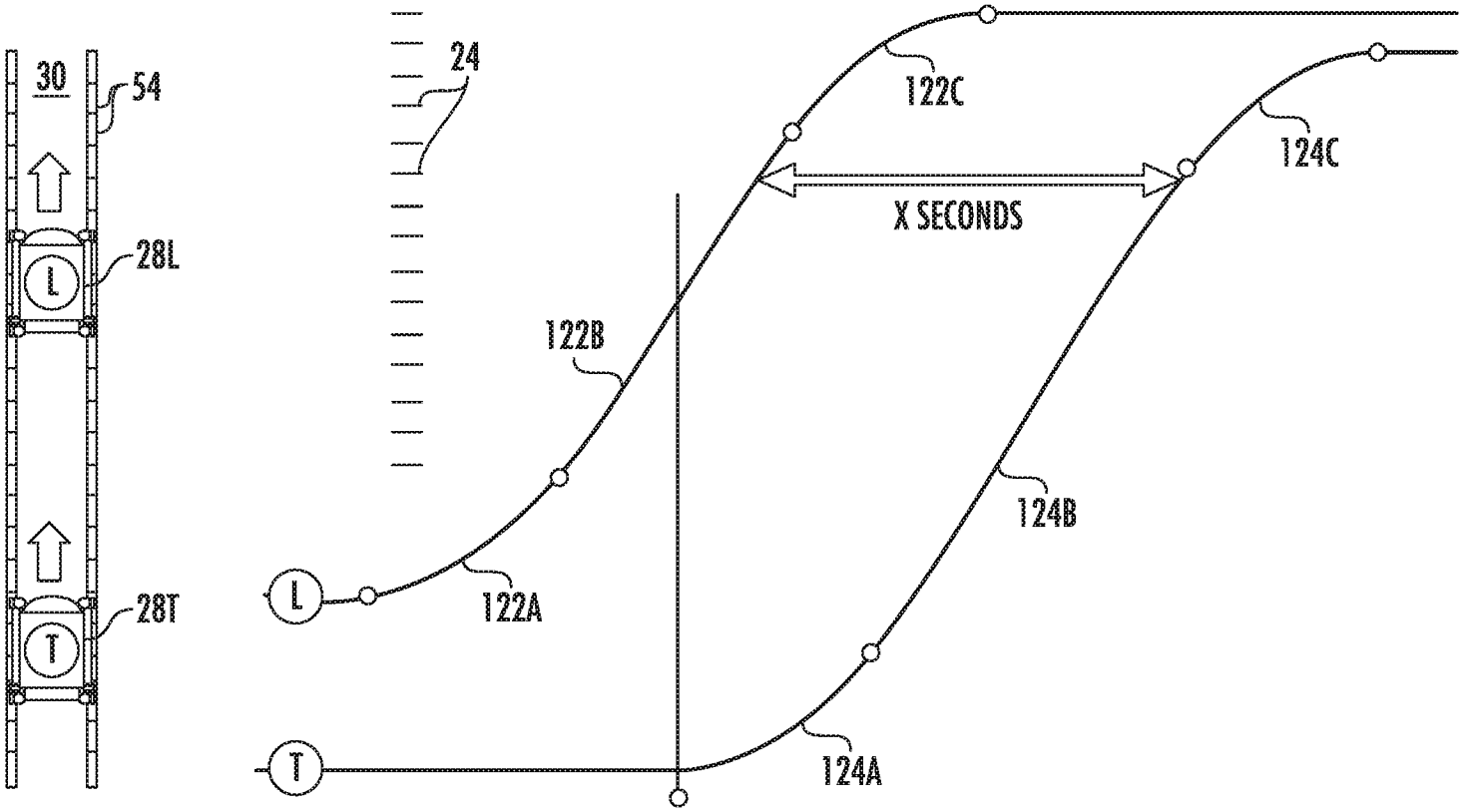
FIG. 6 is a graph of time versus vertical displacement of adjacent elevator cars during a first layer scenario.

Multiple Car Separation Assurance Operation:

Referring to FIGS. 5 through 15, an elevator component separation assurance system 59 of the control system 46 provides separation assurance between elevator components 28 that may be in motion. The elevator component separation assurance system 59 may be an elevator car separation assurance system that, as one non-limiting example, operates under about six modes or layers of operation, and in sequential order from the first layer then to the next sequential layer. As shown in FIGS. 5 and 6, a first layer (i.e., lane supervisor mode) assigns elevator component (e.g., car) destinations in a way that prevents component conflicts and ensures adequate spacing between elevator components or cars 28. The first layer of operation prevents conflicting commands to multiple elevator cars 28. More specifically, during operation of the first layer, the supervisory control module 60 may output a control signal to the lane supervisor 68 that in-turn outputs a control signal to the vehicle control module 72 that outputs a control signal to each of the drives 54. The normal inverter control module 92, the normal motion sensor 94, and the motor primary portion 42 generally operate under normal conditions. Coincidentally, the vehicle control module 72 outputs a control signal to the brake control module 106 over an interface 120 that may be wireless. The brake control module 106 may send a signal to the primary brake 110 to decelerate the elevator car 28 under normal operating conditions. That is, in the first layer, the primary brake 110 acts to generally hold the elevator car 28 after the elevator control system 46 establishes that the car has landed at the floor of interest.

The first layer may generally operate off of knowledge of dictated profiles and updates on car locations when the car reaches a destination. The decision criteria for the first layer may always be active. The layer one output may be car dictated profiles that ensure adequate car separation.

Referring to FIG. 6, a scenario of normal operating conditions under the first layer of operation is illustrated as position versus time. In this example, a leading car 28L may experience a commanded acceleration (see line segment 122A). The leading car 28L may then rise at a prescribed velocity for a number of floors (see line segment 122B) and until a commanded deceleration (see line segment 122C) is received. Under the first layer, the trailing car 28T must remain trailing although the car may come closer to the leading car 28L. In this example, the trailing car 28T must first make a motion request and is not permitted to accelerate (see line segment 124A) until the lane supervisor module 68 permits. Once in motion, the trailing car 28T moves upward at a prescribed velocity (see line segment 124B) and until the trailing car 28T is commanded to decelerate (see line segment 124C).

Figure 7:
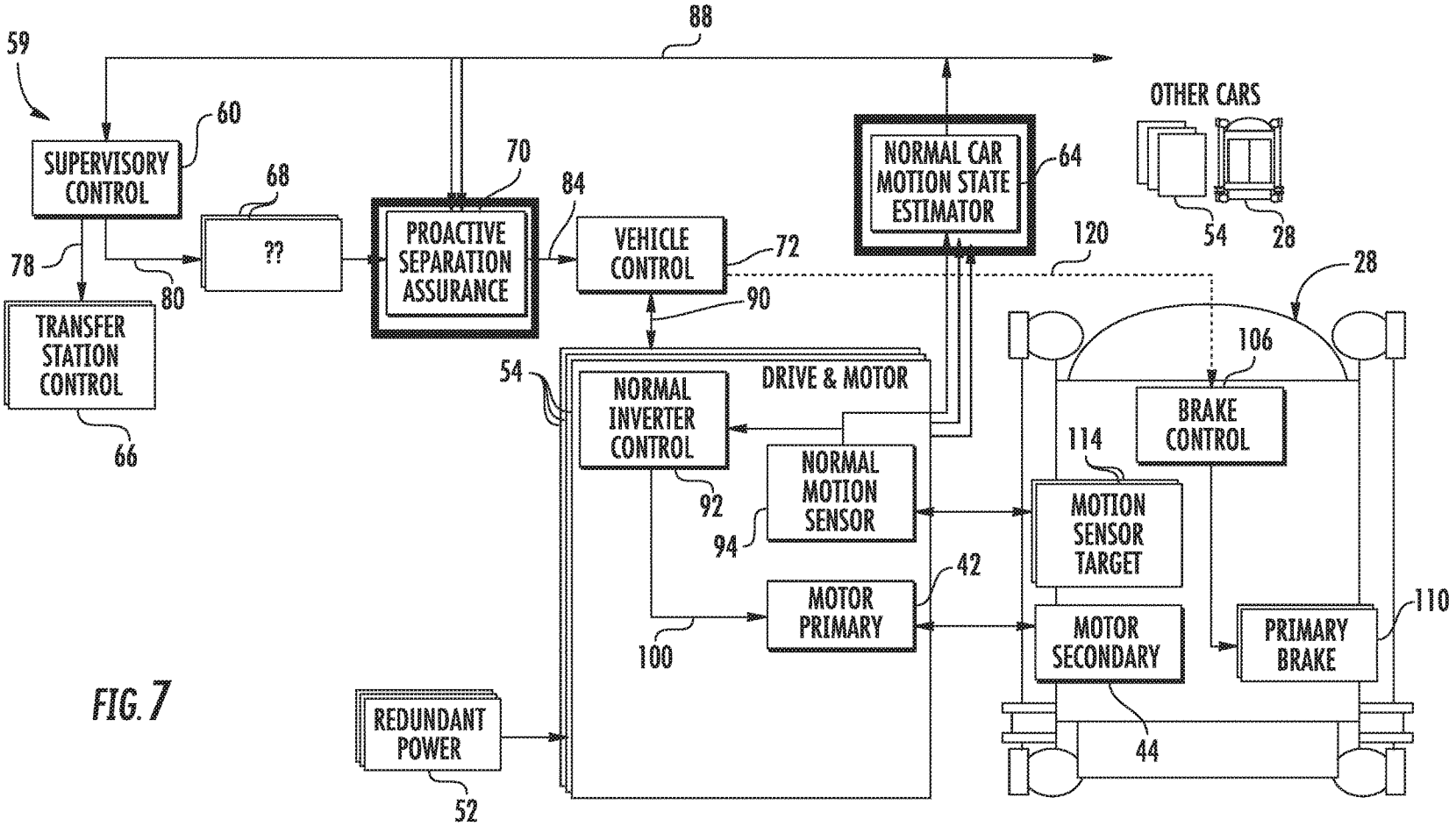
FIG. 7 is a block diagram of the elevator component separation assurance system illustrated in a second layer of operation.
Figure 8:
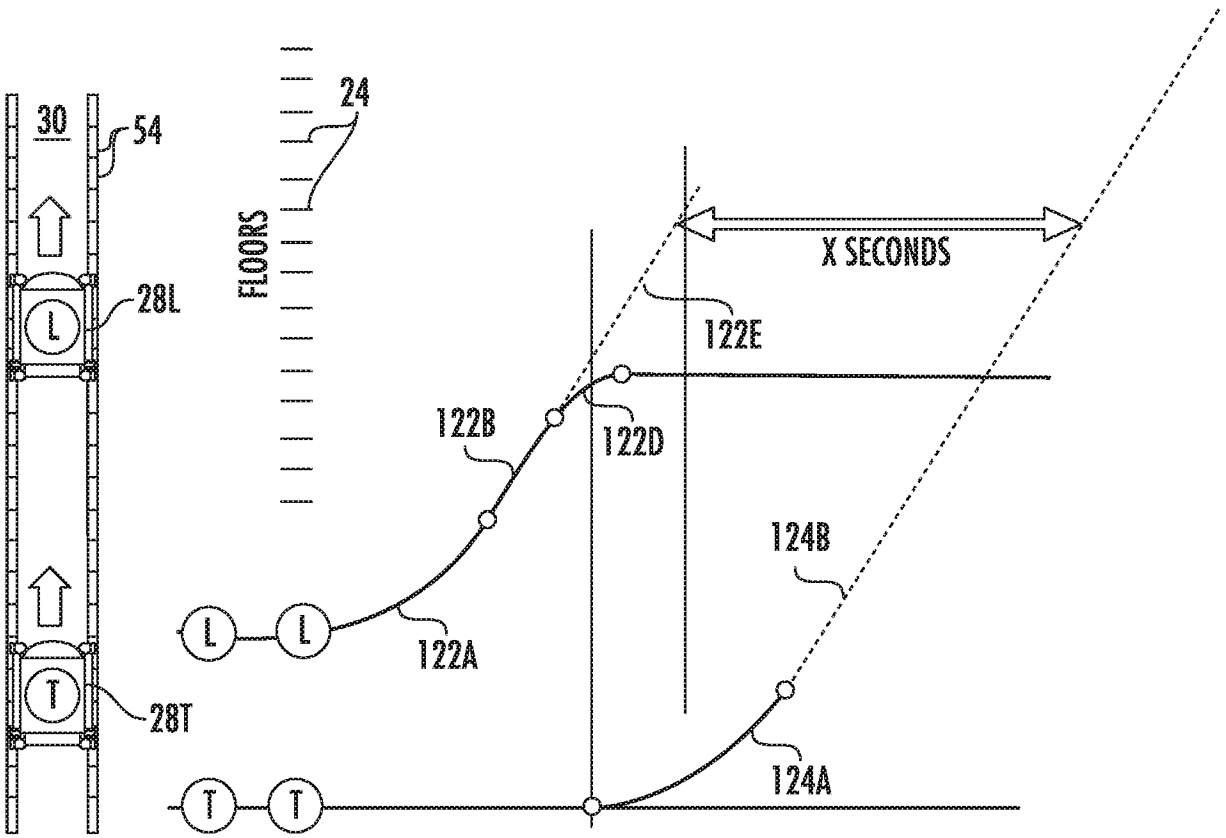
FIG. 8 is a graph of time versus vertical displacement of adjacent elevator cars during a second layer scenario.

Referring to FIGS. 7 and 8, a second layer (i.e., proactive separation assurance mode) generally checks commands before they are executed thus preventing a command which would conflict with another car. More specifically, the second layer initiates when the lane supervisor module 68 is in question. During operation of the second layer, the normal car motion state estimator 64 and the proactive separation assurance module 70 interact. The proactive separation assurance module 70 with the input received from the normal car motion state estimator 64 sends a command signal to the vehicle control module 72 which then communicates with the drives 54 and the elevator cars 28 as described for the first level.

The second layer operates by generally accepting or rejecting the first layer dictation (i.e. commands/requests from the lane supervisor module 68). Inputs for the second layer operation may include knowledge of dictated profiles and position and velocity updates on all cars in a lane. The decision criteria for the second layer may include a check on predicted separation spacing before accepting a dictated profile. The output of the second layer is an acceptance or a rejection of the dictated profiles.

Referring to FIG. 8, a scenario of an operating condition under the second layer of operation is illustrated as position versus time. In this example, a leading car 28L may experience a commanded acceleration (see line segment 122A). The leading car 28L may then rise at a prescribed velocity for a number of floors (see line segment 122B), and until an unexpected braking scenario occurs where the leading car 28L stops short of the intended destination (i.e, represented by dotted line segment 122E). Under the second layer, the trailing car motion request from the lane supervisor module 68 is in question and rejected. That is, the proactive separation assurance module 70 rejects the lane supervisor module request and the trailing elevator 28T does not accelerate and remains at the initial location or floor 24 (i.e., floor).

Figure 9:
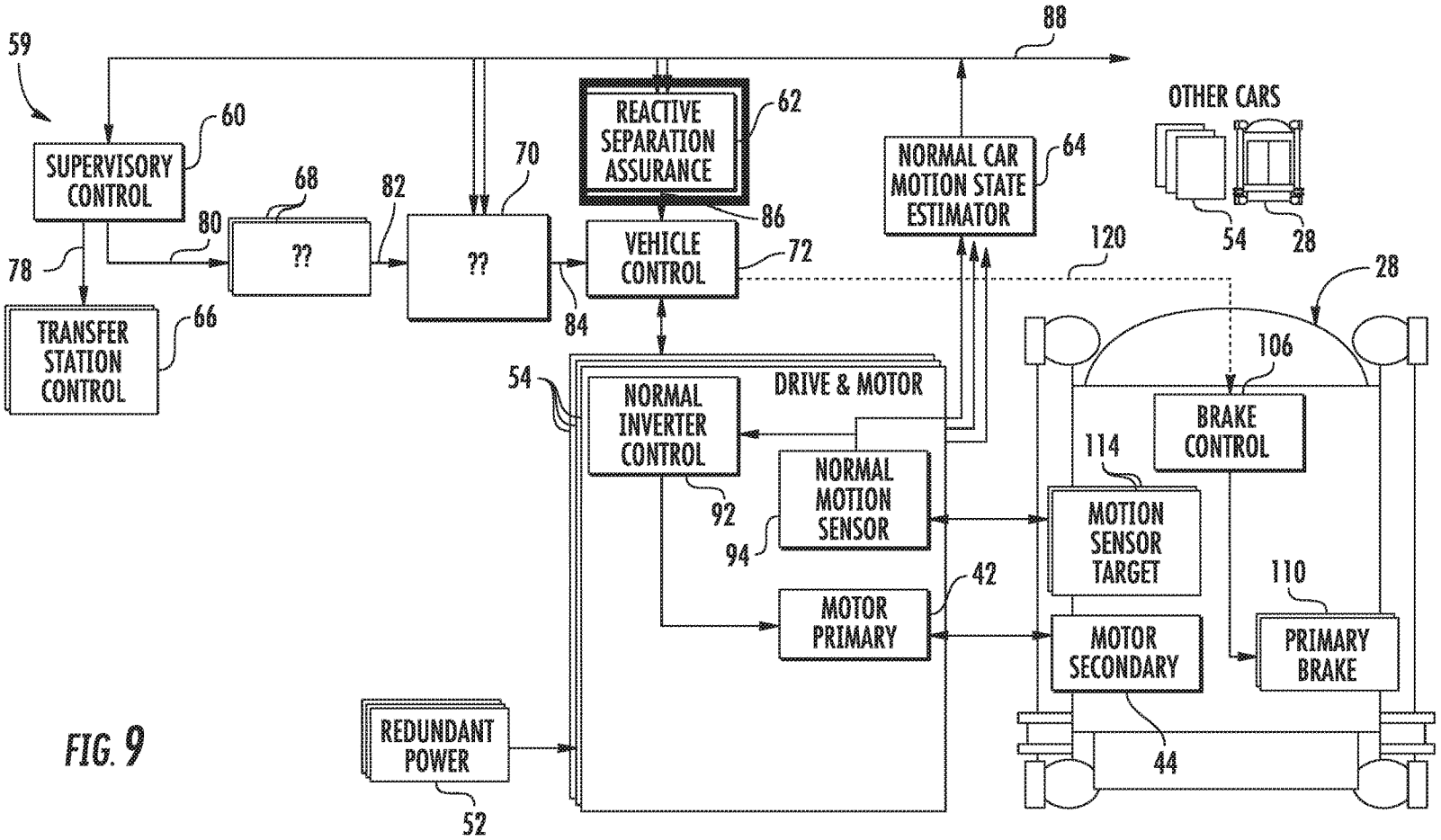
FIG. 9 is a block diagram of the elevator component separation assurance system illustrated in a third layer of operation.
Figure 10:
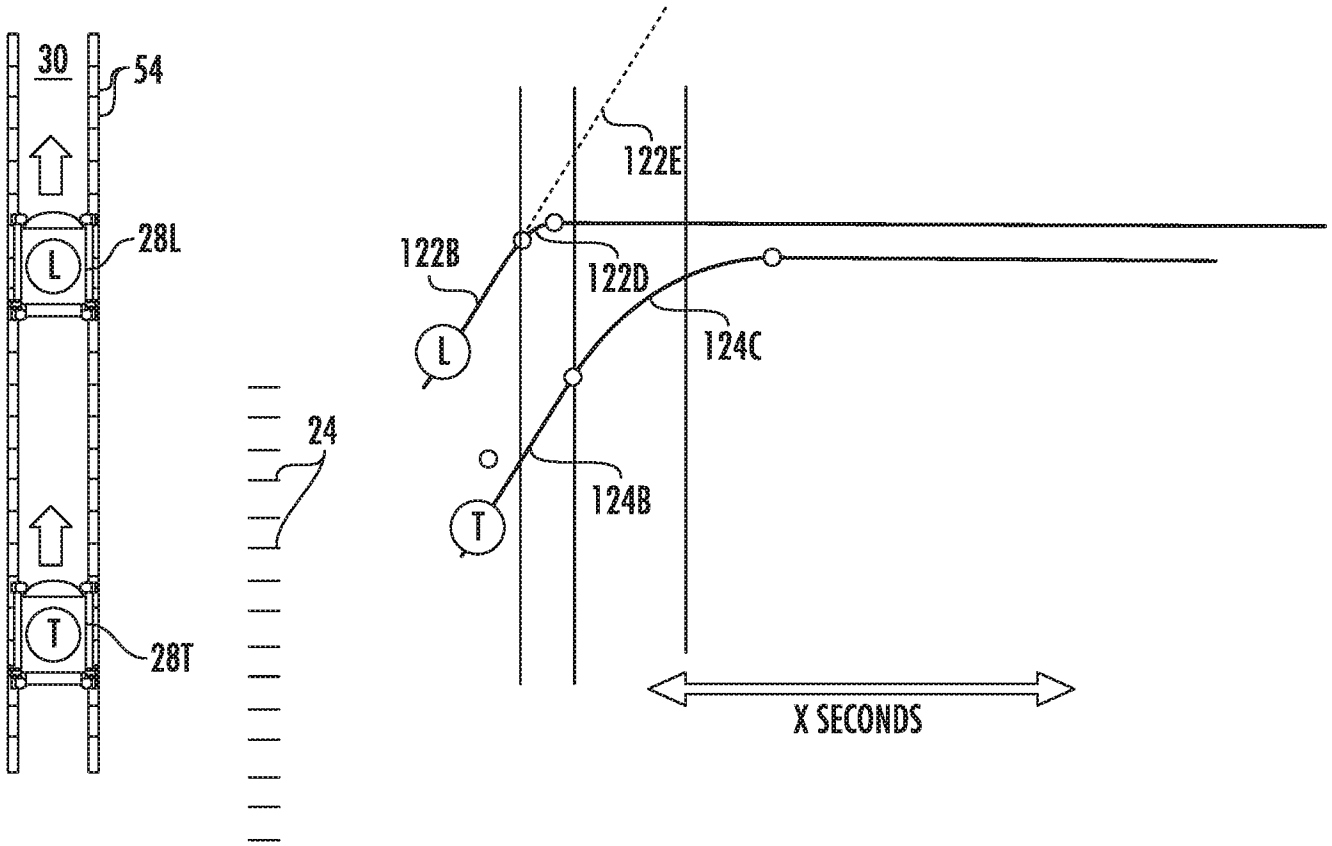
FIG. 10 is a graph of time versus vertical displacement of adjacent elevator cars during a third layer scenario.

Referring to FIGS. 9 and 10, a third layer (i.e., reactive separation assurance mode) generally checks actual car motion against the expected motion profile. The third layer protects against normal motion profile deviations from the expected profiles. More specifically, the third layer initiates when the lane supervisor module 68 and the proactive separation assurance module 70 are in question. During operation of the third layer, the reactive separation assurance module 62 and the vehicle control module 72 interact. The reactive separation assurance module 62 with the input received from the normal car motion state estimator 64 sends a command signal to the vehicle control module 72 which then communicates with the drives 54 and the elevator cars 28 as described for the first level.

The third layer operates by commanding normal deceleration of the trailing car 28T if required. Input for the third layer operation may include position/velocity updates on all cars 28 in a lane. The decision criteria for the third layer may include a check on predicted separation spacing during any point in time and a determination if the trailing car 28T needs to be stopped. The output action of the third layer may include stopping the trailing car 28T with a time-based deceleration rate using the nominal vehicle motion control system.

Referring to FIG. 10, a scenario of an operating condition under the third layer of operation is illustrated as position versus time. In this example, the leading and trailing cars 28L, 28T are both traveling in an upward direction at a prescribed velocity (see respective line segments 122B, 124B). The leading car 28L rises for a number of floors 24, and until an unexpected braking scenario occurs where the leading car 28L stops short of the intended destination. Under the third layer, the trailing car motion request from the lane supervisor module 68 is in question and rejected, and the trailing car 28T is commanded to do a commanded timed deceleration (see line segment 124C) from the reactive separation assurance module 62.

Figure 11:
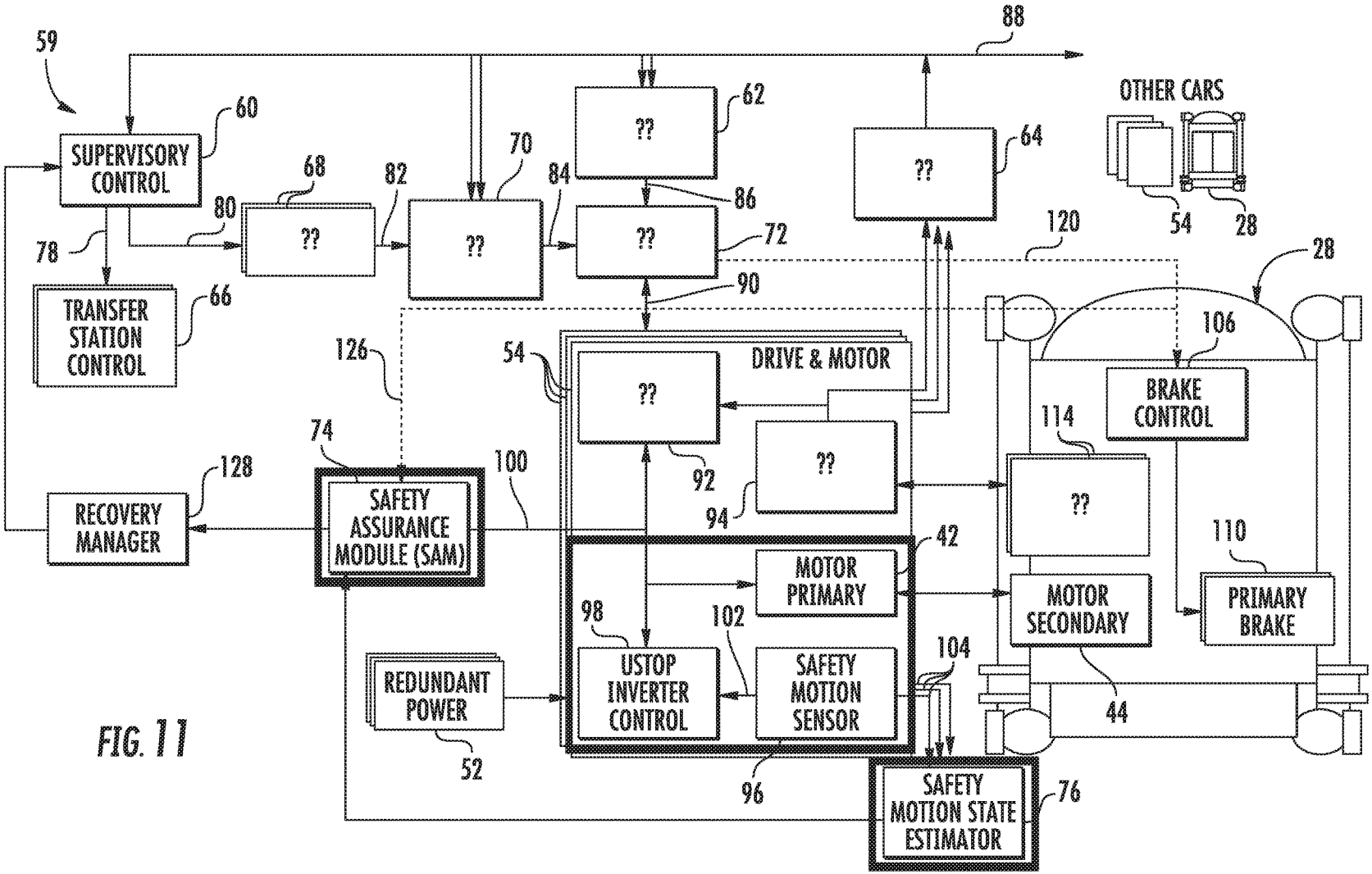
FIG. 11 is a block diagram of the elevator component separation assurance system illustrated in a fourth layer of operation.
Figure 12:
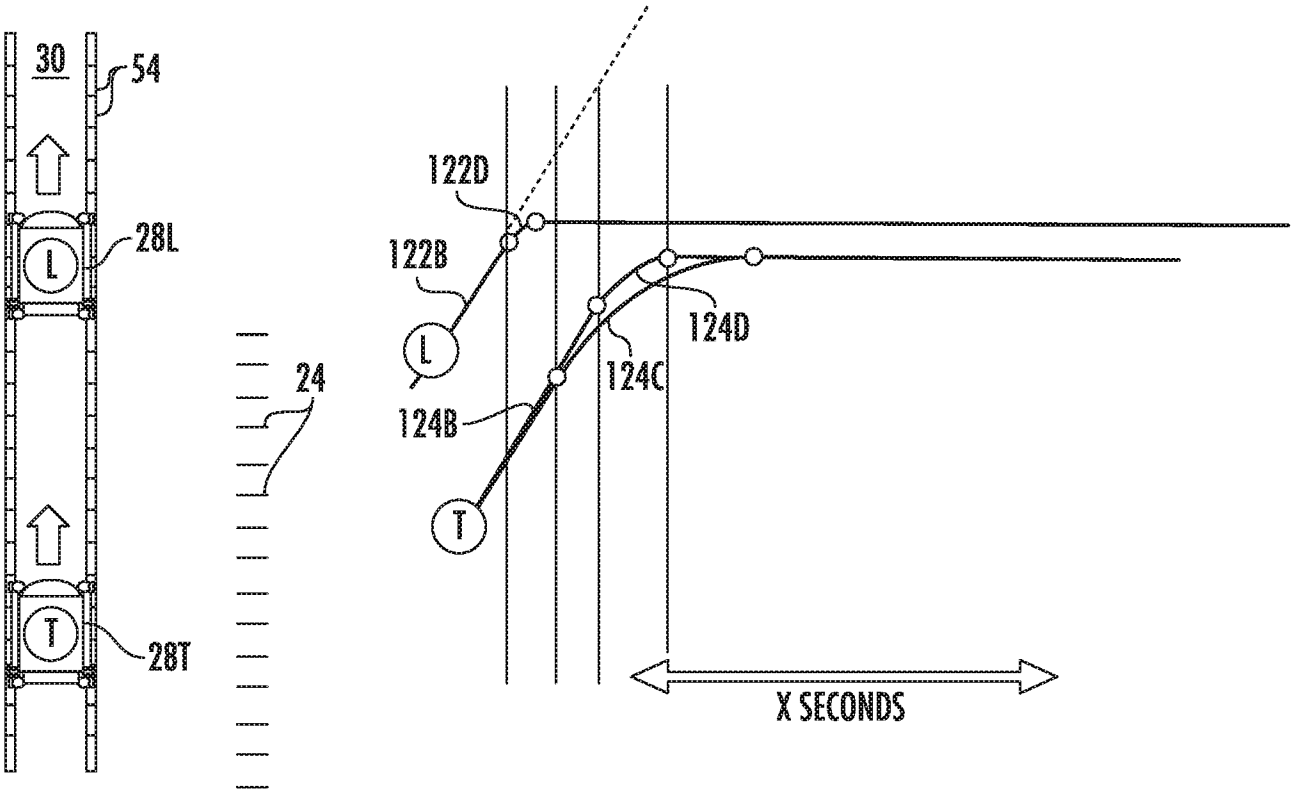
FIG. 12 is a graph of time versus vertical displacement of adjacent elevator cars during a fourth layer scenario.

Referring to FIGS. 11 and 12, a fourth layer (i.e., SAM plus Ustop mode) generally checks car position and velocity for aggressive stopping profile against structural limits (e.g., car, carriage, terminal). The fourth layer may protect against motion control failure. More specifically, the fourth layer initiates when the lane supervisor module 68, the proactive separation assurance module 70, the reactive separation assurance module 62, the vehicle control module 72, the normal car motion state estimator 64, the normal inverter control module 92, and the motion sensor 94 are in question. During operation of the fourth layer, the SAM 74 and the safety motion state estimator 76 interact. The SAM 74 may then output commands to the Ustop inverter control module 98 and the motor primary segment 42 over the interface 100. The SAM 74 may further communicate with the brake control module 106 over an interface 126 that may be wireless.

The fourth layer operates by commanding a Ustop deceleration of the trailing elevator car 28T if required. Input for the fourth layer operation may include position and velocity updates on all cars in a lane. The decision criteria for the fourth layer may include a check on predicted separation spacing during any point in time and a determination if trailing car 28T needs to stop. The output action of the fourth layer may include stopping the trailing car 28T with a time-based deceleration rate using the backup Ustop control system. The output action may further include flagging the fourth layer event to an integrity management function (i.e. part of first layer) indicating that the fourth layer reaction is activated.

Referring to FIG. 12, a scenario of an operating condition under the fourth layer of operation is illustrated as position versus time. In this example, the leading and trailing cars 28L, 28T are both traveling in an upward direction at a prescribed velocity (see respective line segments 122B, 124B). The leading car 28L rises for a number of floors 24, and until an unexpected Ustop scenario occurs (i.e., both primary and secondary brakes actuate 110, 112, see line segment 122D) where the leading car 28L stops short of the intended destination. In this scenario, the intended timed deceleration of the third layer (described above, see line segment 124C) fails and the SAM 74 engages a Ustop (see line segment 124D) for the trailing car 28T.

Figure 13:
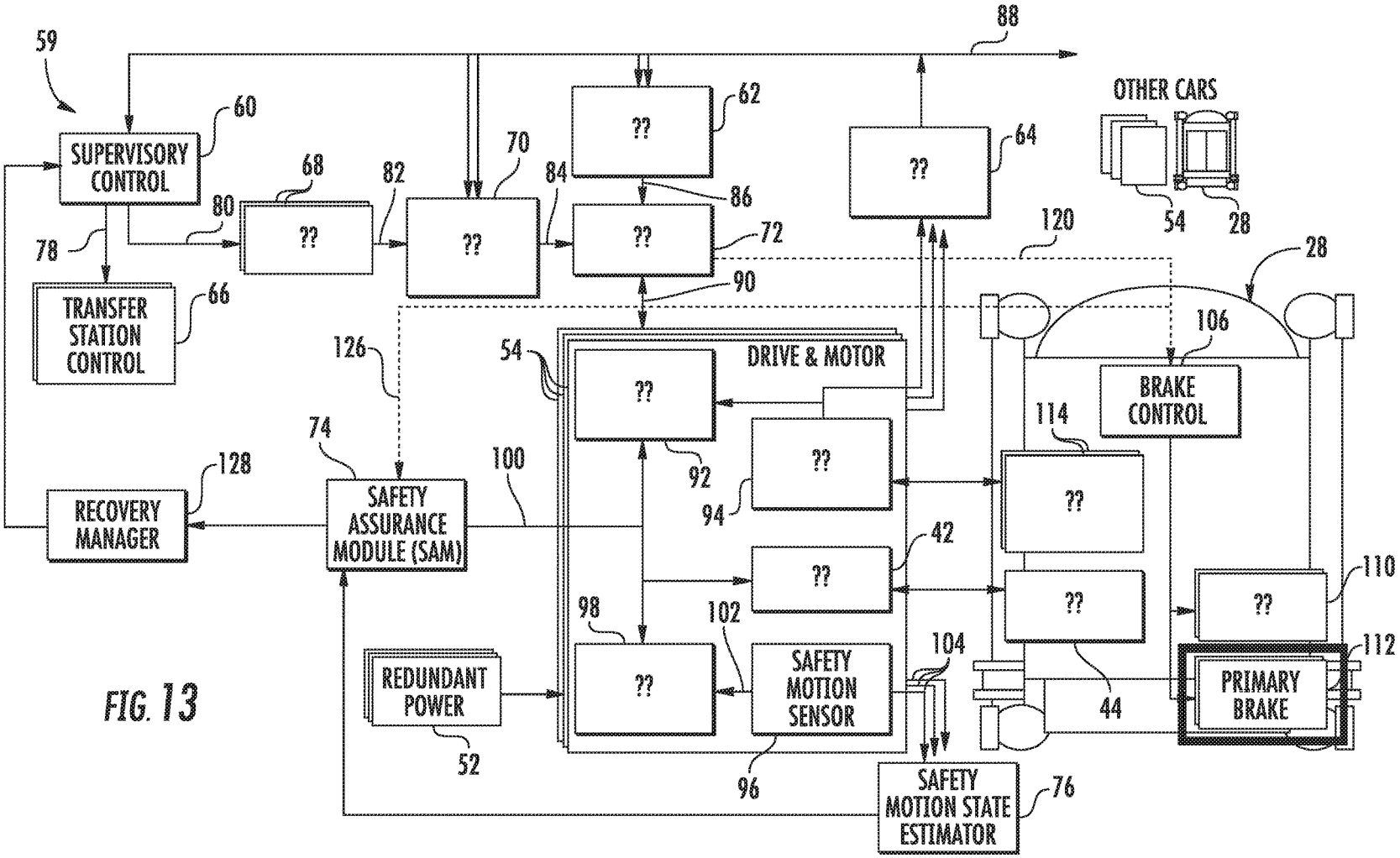
FIG. 13 is a block diagram of the elevator component separation assurance system illustrated in a fifth layer of operation.
Figure 15:
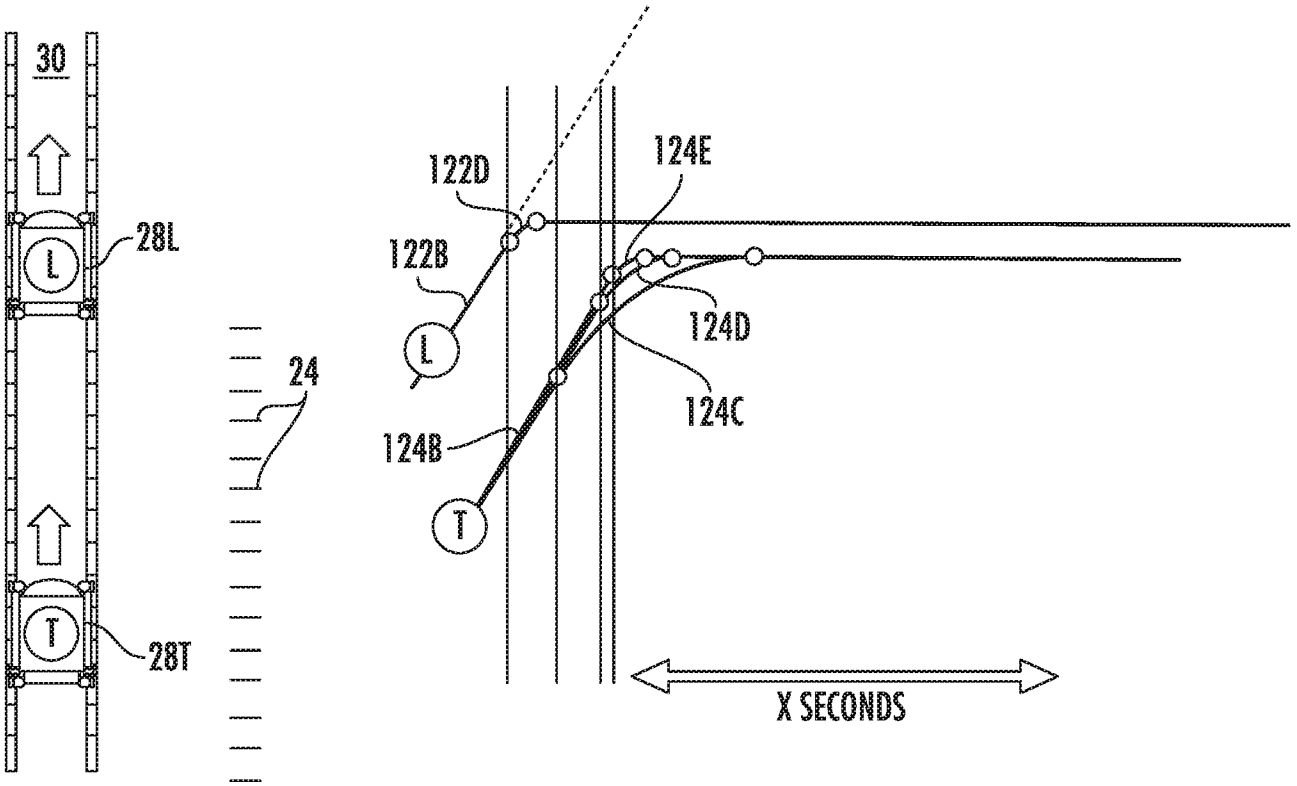
FIG. 15 is a graph of time versus vertical displacement of adjacent elevator cars during a fifth layer scenario.

Referring to FIGS. 13 and 15, a fifth layer (i.e., SAM plus secondary brake 112) activates the secondary brake 112, thereby protecting against a propulsion failure. More specifically, the fifth layer initiates when the lane supervisor module 68, the proactive separation assurance module 70, the reactive separation assurance module 62, the vehicle control module 72, the normal car motion state estimator 64, the normal inverter control module 92, the motion sensor 94, the primary portion 42, the secondary portion 44, the Ustop inverter control module 98, and the primary brake 110 are in question. During operation of the fifth layer, the SAM 74 and the safety motion state estimator 76 interact. The SAM 74 may then output commands to the brake control module 106 over the wireless interface 126. The brake control module 106 may then actuate the secondary brake 112.

The fifth layer operates by commanding a deceleration (i.e., a higher level of deceleration afforded by the on-car secondary brake 112 actuation) of the trailing elevator car 28T if required, and commanding activation of the secondary brake 112 if required. Input for the fifth layer operation may include position and velocity updates on all cars 28 in the lane (e.g., lane 30). The decision criteria for the fifth layer may include a check on predicted separation spacing during any point in time and a determination if the trailing car 28T needs to stop with braking. The output action of the fifth layer may include stopping the trailing car 28T with activation of the secondary brake 112, and flagging the fifth layer event to an integrity management function (i.e. part of first layer) indicating that the fifth layer reaction is activated.

Referring to FIG. 15, a scenario of an operating condition under the fifth layer of operation is illustrated as position versus time. In this example, the leading and trailing cars 28L, 28T are both traveling in an upward direction at a prescribed velocity (see respective line segments 122B, 124B). The leading car 28L rises for a number of floors 24, and until an unexpected braking event, where the leading car 28L stops short of the intended destination. In this scenario, the intended timed deceleration of the third layer for the trailing car 28T (described above, see line segment 124C) fails. Moreover, the Ustop deceleration of the fourth layer for the trailing car 28T (described above, see line segment 124D) also fails and the secondary brake 112 is actuated via the brake control module 106 that receives input from the car speed and acceleration sensing module 108 (see line segment 124E).

Figure 14:
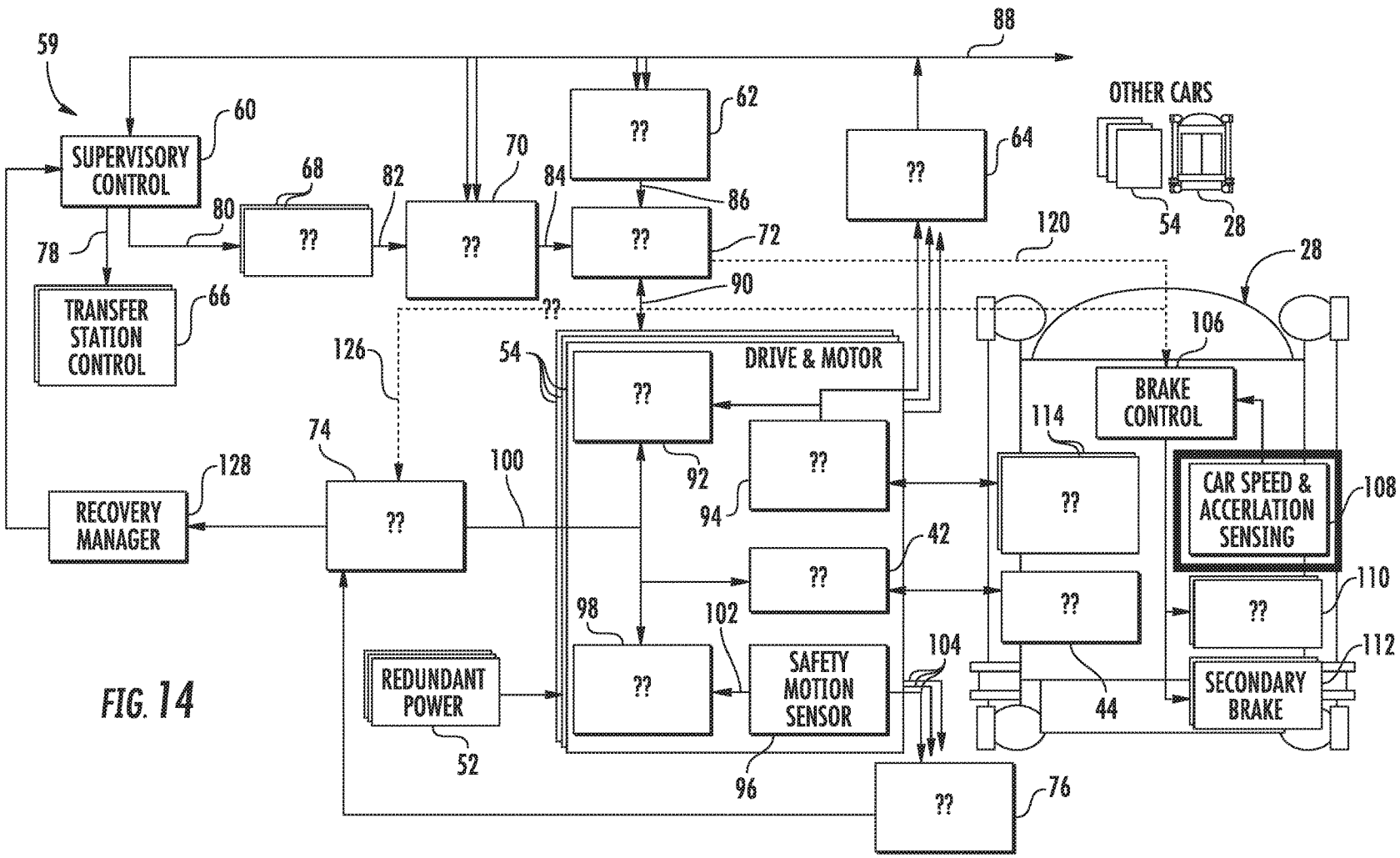
FIG. 14 is a block diagram of the elevator component separation assurance system illustrated in a sixth layer of operation.

Referring to FIG. 14, a sixth layer (i.e., on-car secondary brake 112 actuation) activates the secondary brake 112 if the communication link (i.e., interfaces 120, 126) is down or in question and thus the Ustop 'response' fails. The sixth layer thereby protects against a propulsion failure (i.e., Ustop failure) coupled with a wireless interface failure and/or failure of the SAM 74. More specifically, the sixth layer initiates when the communication link 126 and/or SAM 74 is in question. The sixth layer will initiate whether or not the following components are in question: the lane supervisor module 68, the proactive separation assurance module 70, the reactive separation assurance module 62, the vehicle control module 72, the normal car motion state estimator 64, the normal inverter control module 92, the motion sensor 94, the primary portion 42, the secondary portion 44, the Ustop inverter control module 98, and the primary brake 110. During operation of the sixth layer, the car speed and acceleration sensing module 108 is active and configured to actuate the secondary brake 112.

The sixth layer operates by first verifying that a Ustop deceleration of the trailing elevator car 28T has not occurred. Since there is a loss of communication with the SAM 74, this verification is generally a self-evaluation. That is, the brake control module 106 receives signals from the car speed and acceleration sensing module 108. The signals are then processed to determine if the elevator car speed and deceleration is commensurate to a Ustop event. If not commensurate to a Ustop event, the brake control module 106 (i.e., operating in the sixth layer mode) may command activation of the secondary brake 112.

Input for the sixth layer operation may include an on car accelerometer signal and a diagnostic indicating health of the SAM 74 to on-car brake communication network. The decision criteria for the sixth layer may include a check on the wireless connection, and if the wireless connection is out (i.e., failed), then a determination of whether the car 28T is executing a deceleration rate consistent with a Ustop. If the deceleration is not consistent with a Ustop, then the secondary brake 112 is actuated. The output action of the sixth layer may include stopping the trailing car 28T with activation of the secondary brake 112, and flagging the sixth layer event to the recovery manager 128 indicating that the sixth layer reaction is activated. It is further understood and contemplated that the sixth layer of operation generally constitutes more than elevator car separation assurance. That is, the sixth layer may initiate upon loss of the communication link 126 and regardless of elevator car positions.

Figure 16:
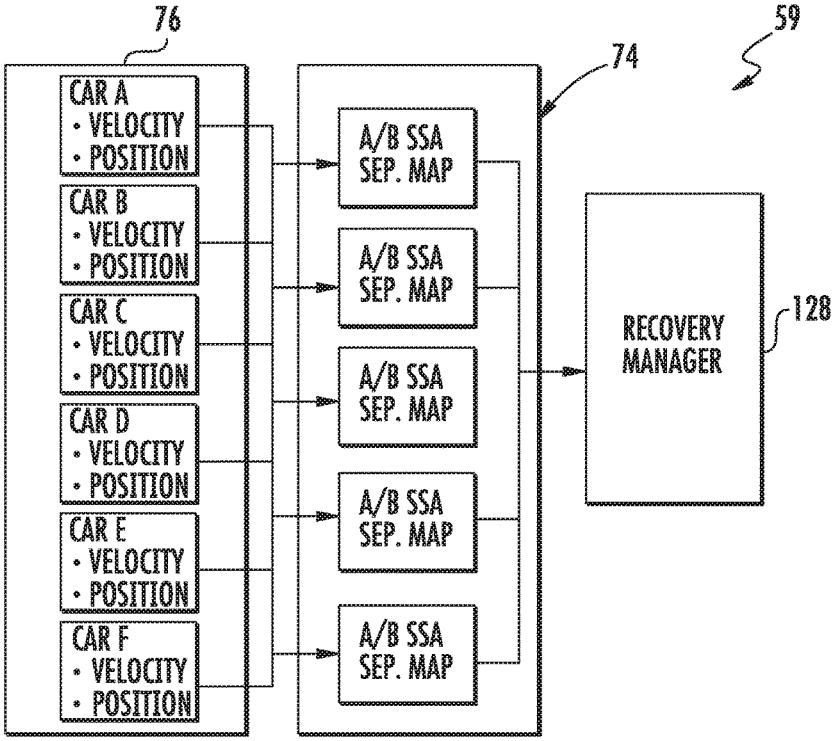
FIG. 16 is a block diagram of the elevator component separation assurance system illustrating a safety motion state estimator, a safety assurance module and a recovery manager.
Figure 17:
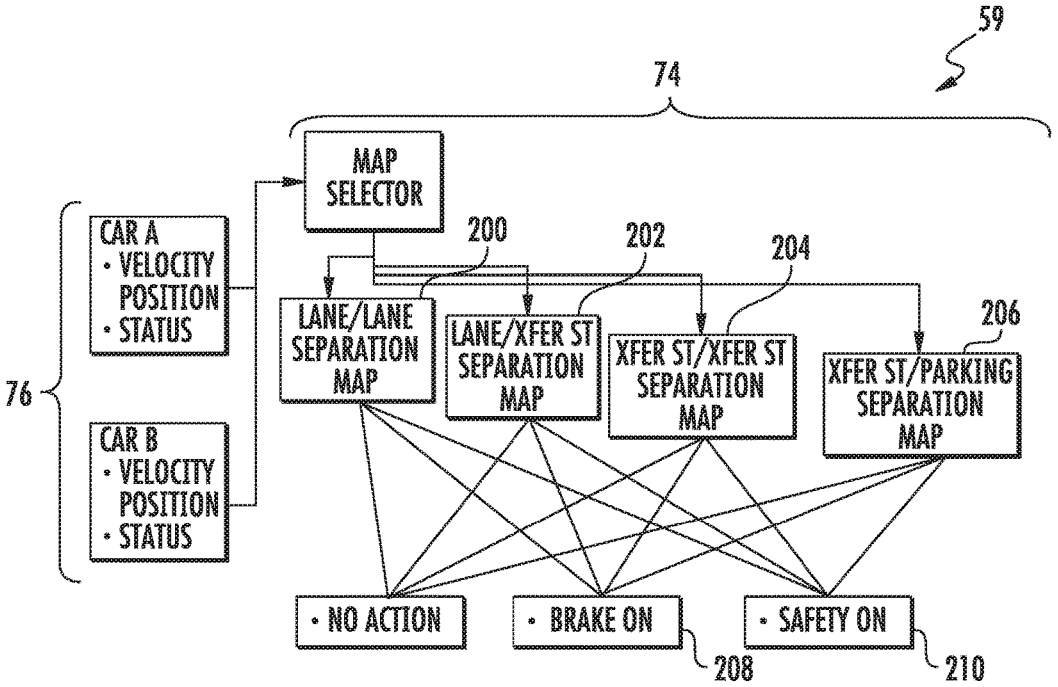
FIG. 17 is a block diagram of the safety assurance module.
Figure 18:
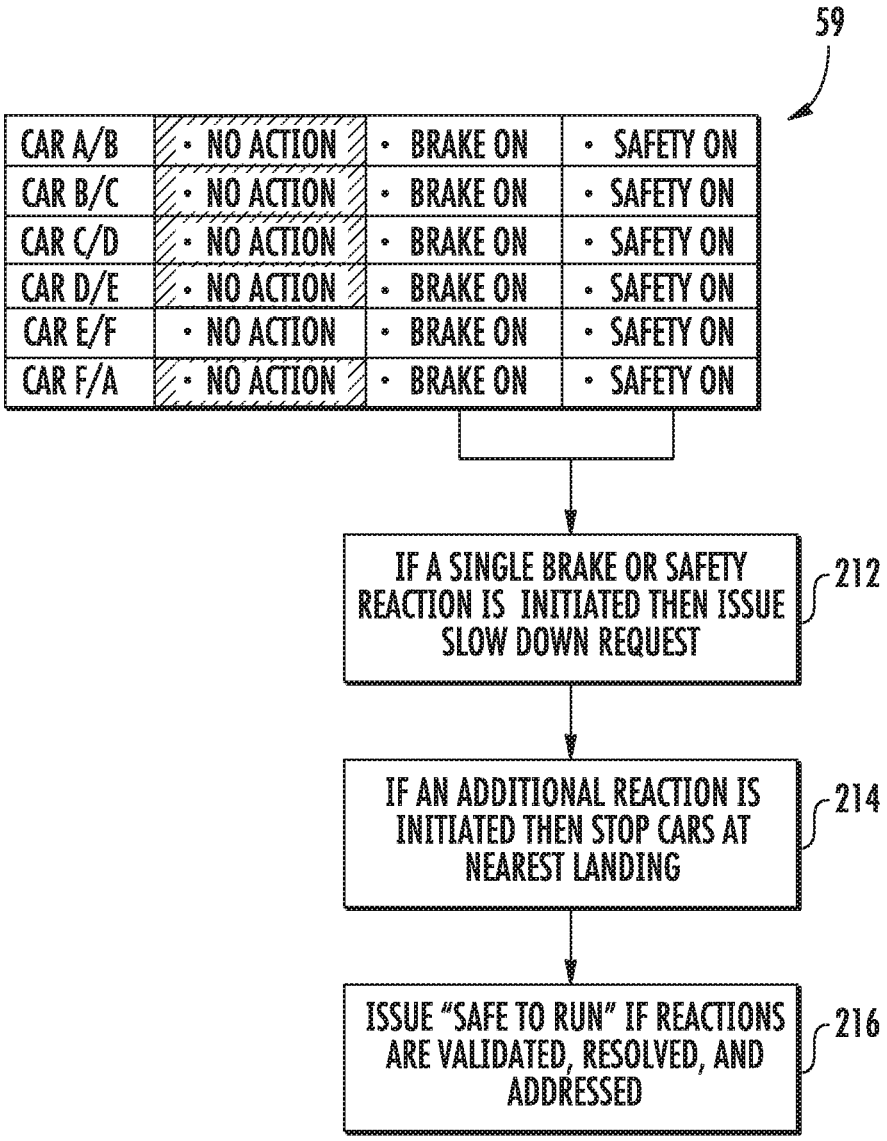
FIG. 18 is a block diagram of the recovery manager.

Car Separation Assurance Management:

Referring to FIGS. 16 through 18, the car separation assurance system 59 may include the safety motion state estimator 76, the SAM 74 and a recovery manager 128. The estimator 76, the SAM 74 and the recovery manager 128 may be substantially software-based and at least in-part programmed into the controller 58. The safety motion state estimator 76 may be configured to identify what elevator cars 28 are active (e.g., moving) and their positions relative to one-another in the elevator system 20. Such positions may include positions in the lanes 30, 32, 34, the transfer stations 36, 38 and the parking station(s) 39 (see FIG. 1). When an elevator car 28 is identified as active, the data signals outputted by the position and velocity sensors are made available to the car separation assurance system 59. The safety motion state estimator signals may include both continuous and discrete information and sensed states of the elevator cars 28.

The SAM 74 is configured to make decisions about whether to drop the primary brake 110 or the secondary brake 112 based on sensory inputs (e.g., velocity, position and status) of two adjacent cars 28 (i.e., see car A and car B in FIG. 17 as one example) and pre-programmed separation maps 200, 202, 204, 206 generally based on the elevator system 20 physical layout. That is, separation map 200 may be based on adjacent elevator cars A, B both being in the same lane 30. Separation map 202 may be based on one elevator car being in lane 30 and the other elevator car being in transfer station 36. Separation map 204 may be based on both elevator cars A, B being in the transfer station 36. Separation map 206 may be based on one elevator car being in transfer station 36 and the other elevator car being in the parking station 39.

The recovery manager 128 is configured to detect and provide notification of a car separation assurance-induced event. The event may be actuation of a Ustop (i.e., brake on, see block 208 in FIG. 17) or actuation of the secondary brake 112 (i.e., safety on, see block 210 in FIG. 17). The notification is provided to the supervisory control module 60 (see FIG. 4) and serves to temporarily reduce car speeds to minimize any potential for insufficient separation of all cars from one-another (see block 212 in FIG. 18). If multiple safety actions are detected, the recovery manager 128 may be configured to stop all elevator cars 28 at the nearest reachable floor 24 (see block 214). It is further contemplated and understood that the recovery manager 128 may be configured to confirm when it is "safe to run" following a separation assurance-induced event (see block 216). It is further contemplated and understood that the car separation assurance-induced event may be other than a Ustop or actuation of a secondary brake. It is further understood that the reaction to the event(s) by the recovery manager 128 may include other actions and/or a different number of events must take place for certain actions to be initiated.

It is understood and contemplated that the elevator component separation assurance system 59 may entail the separation of cars as previously described, but may also entail separation of cars from, for example, empty carriages in transfer stations and/or dynamic terminals.

While the present disclosure is described with reference to exemplary embodiments, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. An elevator component separation assurance system comprising:

a controller including an electronic processor, a computer readable storage medium, a safety motion state estimator configured to identify velocity and position of each one of a plurality of elevator components, and a safety assurance module configured to select a pre-programmed separation map from a plurality of pre-programmed separation maps for each one of an adjacent component pair of the plurality of elevator components for initiating a Ustop that maintains elevator component separation; and a brake controller carried by each one of the plurality of elevator components and configured to actuate a secondary brake upon detection of a loss of communication with at least a portion of the controller.

2. The elevator component separation assurance system set forth in claim 1, wherein the safety motion state estimator and safety assurance module are software-based.

3. The elevator component separation assurance system set forth in claim 1 further comprising:

a recovery manager configured to communicate with the safety assurance module and reduce the speed of at least one of the plurality of elevator components based on actuation of the Ustop.

4. The elevator component separation assurance system set forth in claim 1, wherein the brake controller is configured to initiate a secondary brake upon a loss of communication with the safety assurance module.

5. The elevator component separation assurance system set forth in claim 4, wherein the brake controller is configured to determine if a Ustop has occurred before initiating the secondary brake.

6. The elevator component separation assurance system set forth in claim 3, wherein the safety assurance module is configured to actuate a secondary brake for maintaining elevator component separation, and the recovery manager is configured to reduce the speed of the plurality of elevator components based on actuation of the secondary brake.

7. The elevator component separation assurance system set forth in claim 3, wherein the recovery manager is configured to stop at least one of the plurality of elevator components based on actuation of a plurality of Ustops by the safety assurance module.

8. The elevator component separation assurance system set forth in claim 3, wherein the recovery manager is configured to stop at least one of the plurality of active elevator components based on at least one actuation of a Ustop by the safety assurance module and at least one actuation of a secondary brake by the safety assurance module.

9. The elevator component separation assurance system set forth in claim 3, wherein the recovery manager is configured to confirm when it is safe to run following the actuation of the Ustop.

10. The elevator component separation assurance system set forth in claim 1, wherein the adjacent component pair includes a first car disposed in a lane and a second car disposed in a transfer station.

11. The elevator component separation assurance system set forth in claim 1, wherein the adjacent component pair includes a first car disposed in a transfer station and a second car disposed in a parking station.

12. The elevator component separation assurance system set forth in claim 1, wherein the plurality of elevator components is a plurality of ropeless elevator cars.

* * * * *